United States Patent [19]

Duryea

[11] 4,135,476

[45] Jan. 23, 1979

[54] SEALANT APPLICATOR

[75] Inventor: Josiah T. Duryea, Seattle, Wash.

[73] Assignee: The Boeing Company, Seattle, Wash.

[21] Appl. No.: 847,575

[22] Filed: Nov. 1, 1977

[51] Int. Cl.[2] ..... B05C 1/02; B05C 7/06

[52] U.S. Cl. ..... 118/259; 118/263

[58] Field of Search ..... 118/215, 243, 263, 254, 118/258, 259, 261

[56] References Cited

U.S. PATENT DOCUMENTS

| | | | |
|---|---|---|---|
| 2,575,007 | 11/1951 | Deland | 118/254 |
| 3,332,394 | 7/1967 | Cooke | 118/263 |
| 3,904,718 | 9/1975 | Kuehn, Jr. | 118/263 X |
| 3,952,697 | 4/1976 | Bonkoske | 118/263 |

*Primary Examiner*—John McIntosh

*Attorney, Agent, or Firm*—Christensen, O'Connor, Johnson & Kindness

[57] ABSTRACT

A sealant applicator for applying a sealant to the countersink portion of a rivet bore in a workpiece includes an applicator head, a sealant supply, and a drive unit for moving the applicator head between the countersunk surface and the sealant supply. A sealant dauber is rotatably and adjustably mounted on the applicator head and is driven by a motor, also mounted on the head. A flexible applicator tip is fitted to one end of the dauber for receiving sealant from the sealant supply and applying it to the countersink surface. The sealant is supplied to the applicator tip from a reservior having an opening in which is located a sealant permeable member. Sealant is supplied to the reservoir from a sealant cartridge. A predetermined amount of sealant is passed through and is maintained above the permeable member before the applicator tip contacts the permeable member. When the applicator tip engages the permeable member a bead of sealant attaches to the tip. As the rotating applicator tip is removed from the reservoir opening, the sealant is sheared from the central portion of the permeable member, leaving a uniform annular bead of adhesive that is precisely positoned on the applicator tip. The applicator tip is then inserted in the rivet bore so that the tip surface engages the countersink surface and transfers the sealant to the countersink surface. The drive unit moves the applicator head, and thus the applicator tip, sequentially between three locations: a standby location wherein the tip is positioned adjacent and above the rivet bore; a workpiece engagement location wherein the tip engages the rivet bore; and a supply location wherein the tip engages the permeable member in the reservoir.

15 Claims, 12 Drawing Figures

SEALANT APPLICATOR

BACKGROUND OF THE INVENTION

This invention relates to an apparatus for applying sealant to a bore in a workpiece, and more particularly, to an apparatus for applying sealant to a portion of a rivet bore in a workpiece that is readily adaptable for operation with a device for automatically boring and riveting the workpiece.

Riveted aircraft structures, such as the skin on an aircraft wing, are subject to failure because corrosive materials penetrate along the rivet-skin interface, causing corrosion and possible subsequent failure of the rivet connector and surrounding structure. To prevent corrosive materials from penetrating the rivet-skin interface, sealants and/or primers are applied to a portion of the rivet bore before the rivet is inserted and fastened in the bore.

Mechanical devices for applying sealant to the rivet bore, and specifically to a countersink forming part of the rivet bore, are normally used in connection and coordination with automatic riveting machines that drill a bore and countersink bore in the skin or other workpiece and thereafter insert and fasten the rivet in the bore. Prior art sealant applicators will normally apply excess sealant to the rivet bore, causing sealant material to be squeezed from the bore when the rivet is inserted and thus be deposited on the surface of the workpiece. Even if the problem of excess sealant application is not present, most of the prior art devices will pull a string of adhesive away from the rivet bore as the applicator is withdrawn from the bore. This stringing of the adhesive results in sealant deposition on the surface of the skin. The sealant deposited on the skin must be removed prior to use of the workpiece, requiring extra labor, energy and time to produce a finished structure.

An example of such prior art sealant applicators is described in U.S. Pat. No. 3,904,718, issued to Kuehn on September 9, 1975. The Kuehn applicator utilizes a frusto-conically shaped applicator tip that is shaped to precisely mate with the countersink surface of the workpiece bore. An annular groove is located on the circumference of the conical surface of the applicator tip so that the groove is adjacent the countersink surface when the applicator tip is inserted into the workpiece bore. Sealant is applied to the applicator tip by causing the groove of the applicator tip to engage a bead of sealant carried by a tape. As the tip is rotated when in contact with the tape, sealant is picked up by the applicator tip in the grooved area and excess sealant remaining from the previous cycle is removed from the applicator tip by the tape.

The Kuehn applicator, although representing a significant advance in the art, suffers from several deficiencies. In order to deposit the bead of sealant in the correct position within the countersink in the aperture of the workpiece, the rotational axis of the applicator tip must be exactly aligned with the centerline of the workpiece bore and the conical surface of the applicator tip must mate exactly with the surface of the countersink. Moreover, each applicator tip will only fit into a countersink of given dimensions. A slight misalignment of the applicator tip and the countersink or a slight difference between the angle of the countersink and the conical shape of the applicator tip can result in a misplacement of the bead of sealant within the countersink. Also, when the applicator tip is rotating at high rpms, an incorrect positioning of the applicator tip within the workpiece bore could cause the tip to "jump out" of the countersink. These problems are compounded because it is difficult to manufacture and maintain a drill bit that will create a countersink surface within a workpiece that will precisely mate with the conical shape of the rotating applicator tip. Moreover, because the Kuehn applicator head is not adjustable relative to its base, the entire Kuehn apparatus must be exactly positioned relative to the workpiece and the countersink to insure that the applicator tip will be precisely aligned with the centerline of the workpiece bore. The initial alignment of the Kuehn applicator, as installed with an automatic riveting machine, with respect to the centerline of a pressure foot bushing and with respect to the placement of a bead of sealant on the tape takes a person of ordinary skill in the art about 10 to 20 hours. Additionally, the Kuehn applicator tip must be exactly aligned with respect to the bead of sealant placed on the moving tape. A slight mismatch between the bead of sealant on the tape and the groove on the applicator tip causes an insufficient amount of sealant to be placed within the groove of the applicator tip and a corresponding inadequate amount of sealant applied to the countersink, resulting in an inadequate seal of the rivet.

Furthermore, because an automatic riveting machine is constantly vibrating, minor alignment adjustments must be made to the applicator tip. Since the entire Kuehn apparatus must be readjusted to maintain correct alignment, the entire riveting sealing operation must be stopped for a relatively long period to correct the tip alignment, resulting in a significant loss of productive work time. Also, when a Kuehn applicator tip is changed to correspond to different countersink angles and diameters, the groove of the applicator tip must again be aligned with the bead of sealant on the tape.

The sealant supply mechanism disclosed by Kuehn has also been a source of problems. In Kuehn a sealant metering orifice is in fluid communication with a sealant supply source. When the tape moves past the metering orifice, the metering orifice forms a bead of sealant on the tape. The bead of sealant is then transferred to the groove in the applicator tip and excess sealant on the tip is removed by the tape. The tape transfer sealant supply system is unduly complicated and unreliable. Excess sealant cleaned from the applicator by tape is wastefully discarded with the tape. The problem of aligning the applicator tip with the bead of sealant on the tape has been discussed above. Additionally, the feed mechanism must be adjusted to align the tape with respect to the metering orifice to insure that the bead of sealant is correctly positioned on the tape. Also, the metering orifice is rather inaccessably located within the apparatus and therefore difficult to clean. For these reasons the Kuehn sealant applicator, and other devices and methods known as a part of the prior art have not been satisfactory.

It is therefore a broad object of this invention to provide an improved, simplified apparatus for placing an annular bead of sealant material on the wall of the workpiece bore.

A second object of this invention is to provide a sealant applicator that includes an applicator tip which is adjustably positionable with respect to the centerline of a workpiece bore so that during use of the applicator, minor alignment corrections can easily be made.

It is another object of this invention to provide a sealant applicator that will pick up an annular bead of sealant from a sealant supply and apply the bead to a workpiece bore without being precisely aligned either with respect to the sealant supply or the bore.

It is yet another object of this invention to provide a sealant applicator having an uncomplicated and durable sealant supply mechanism.

It is another object of this invention to provide a sealant applicator that will minimize the waste of sealant.

It is still another object of this invention to provide a sealant applicator which minimizes stringing of sealant.

SUMMARY OF THE INVENTION

In accordance with the principals of this invention, an applicator for applying an annular bead of sealant to a wall of an aperture in a workpiece is provided. As used herein the term "sealant" is intended to encompass all materials that will prevent fluid from penetrating the rivet-skin interface in a riveted structure, for example, adhesives, primers and other compositions that can function as sealants. A flexible convexly contoured applicator tip is affixed to one end of a dauber, the dauber being rotatably mounted on an applicator head. The dauber is rotated by a motor mounted on the applicator head. Sealant is supplied to a reservoir having an opening and a sealant-permeable member retained over the opening. The permeable member has a shearing surface that communicates with the exterior of the reservoir and sealant is supplied to the reservoir to feed sealant through the permeable member and provide a predetermined amount of sealant evenly over the shearing surface. The applicator tip is caused to be moved between a supply position wherein the applicator tip contacts the shearing surface to receive an annular bead of sealant thereon, and a workpiece engagement position wherein the applicator tip engages the aperture wall in the workpiece to apply an annular bead of sealant to the aperture wall.

In accordance with further principles of this invention, the applicator tip has a lower portion that is hemispherically-shaped. In the supply position, a section of the hemispherically-shaped lower portion of the applicator tip presses against the shearing surface of the sealant supply and an annular bead of sealant is formed on the hemispherically-shaped lower portion of the applicator tip adjacent the section of the tip contacting the shearing surface. In the workpiece engagement position, the section of the hemispherically-shaped lower portion of the applicator tip containing the annular bead of sealant mates with the walls of the workpiece aperture.

In accordance with further principles of this invention, the applicator tip is further moved to and from a standby position located between the supply and workpiece engagement positions, wherein the applicator tip is positioned adjacent the workpiece in readiness for movement to the workpiece engagement position.

In accordance with further principles of this invention, the applicator head has a base member and a swingable member rotatively mounted on the base member. The swingable member includes the dauber rotatively mounted within a dauber housing. The dauber housing is mounted on a dauber support plate to allow three-dimensional adjustment relative to the dauber support plate.

In accordance with further principles of this invention, the base member is moved in a straight line between a first, a second and a third position. A cam mechanism associated with the swingable member rotates the swingable member about an axis transverse to the straight line path of travel of the base member when the base member approaches and leaves the second and third positions, which correspond to the workpiece engagement and the supply positions of the applicator tip, respectively.

It will be appreciated from the foregoing brief summary that the invention provides a new and improved sealant applicator. Because the applicator tip is flexible, it will deform slightly when the tip contacts the shearing supply and when the tip mates with the wall of a workpiece aperture. Further, an annular bead of sealant is formed and precisely positioned on the applicator tip without precisely aligning the tip with the sealant supply. As long as the tip contacts the shearing surface of the sealant supply, an annular bead of sealant will be formed on the section of the applicator tip that is adjacent the portion actually in contact with the shearing surface.

The sealant supply is uncomplicated and durable in that it requires only a reservoir and a permeable member with a shearing surface, and a sealant supply source that deposits a predetermined amount of sealant above the shearing surface.

Most of the components of this invention, including the dauber, are adjustable so that alignment of the applicator tip with the centerline of a workpiece aperture is more easily accomplished and is less time consuming than prior art devices. Additionally, the applicator tip can be moved to the workpiece aperture, engage the wall of the aperture and evenly deposit an annular bead of sealant thereon, and be moved away from the workpiece aperture betwen the normal drilling and riveting cycles on an automatic riveting machine (e.g. 0.1 second). Therefore, the invention is readily adaptable to current automatic riveting machines.

BRIEF DESCRIPTION OF THE DRAWINGS

The foregoing invention and many of its attendant advantages will become more readily appreciated as the same becomes better understood by reference to the following detailed description when taken in conjunction with the accompanying drawings wherein.

DESCRIPTION OF THE PREFERRED EMBODIMENT

Figure 1:
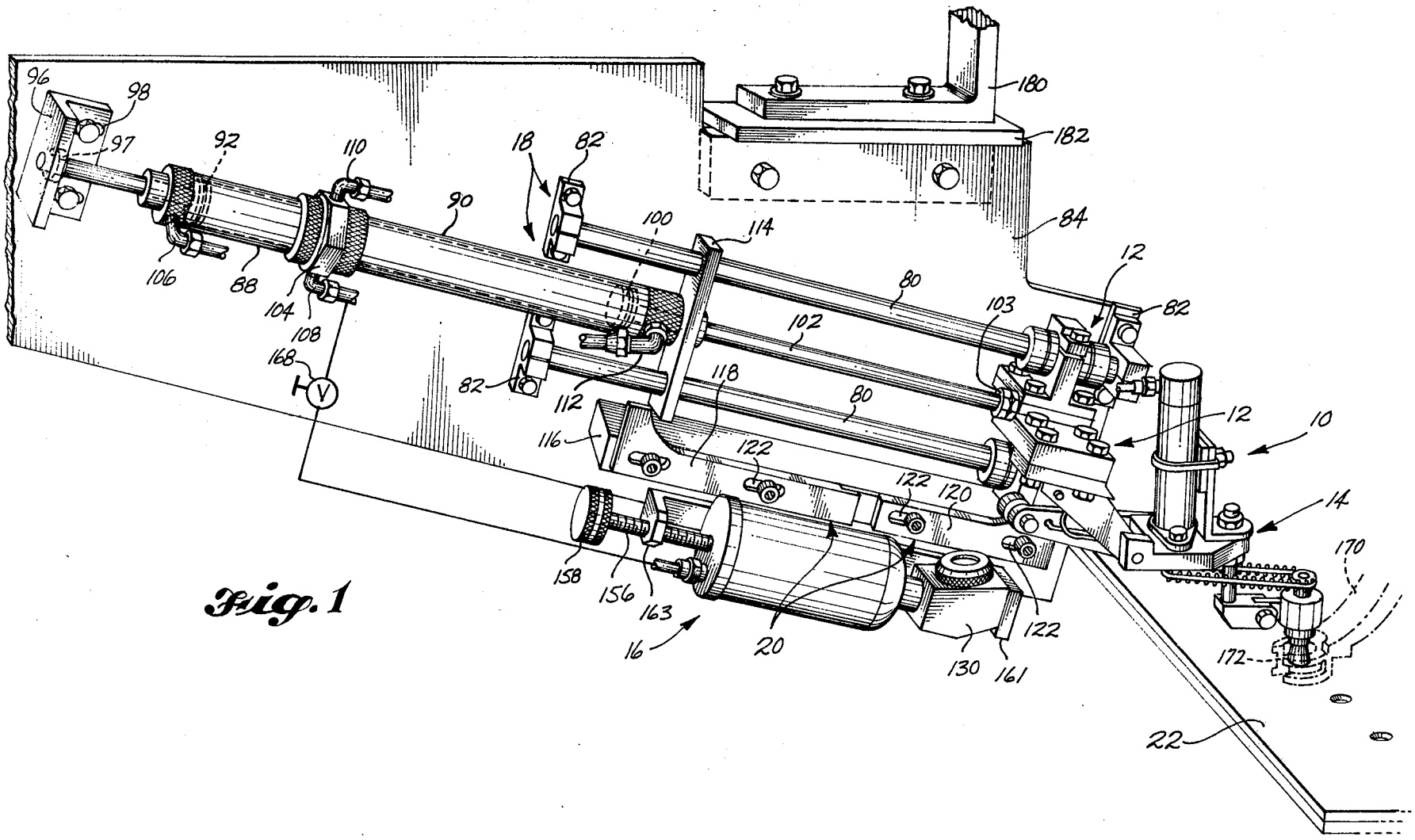
FIG. 1 is a perspective view of the sealant applicator of the present invention showing the applicator tip in contact with a workpiece.

In the embodiment of the invention illustrated in FIG. 1, the applicator has four basic units: applicator head 10, sealant supply 16, head reciprocating unit 18, and a cam mechanism 20. The applicator head consists of two subassemblies: a base member 12 and a swingable member 14. The head reciprocating unit 18 cooperates with the base member 12, and the cam mechanism cooperates with the swingable member 14 of applicator head 10 so that applicator tip 30 can be moved to and from a variety of positions. In the disclosed embodiment of this invention, the applicator tip 30 normally rests in a standby position, wherein the applicator tip 30 on swingable member 14 is adjacent and above an aperture 24 in a workpiece 22. When base member 12 is moved by the head reciprocating unit 18 toward the workpiece 22, the swingable member 14 cooperates with cam mechanism 20 so that applicator tip 30 engages the wall 23 of the aperture 24 in the workpiece 22 to deposit a bead of sealant 28 thereon (the position illustrated in FIG. 1). The reciprocating unit 18 then moves base member 12 toward the sealant supply 16. As the base member moves away from the workpiece, the swingable member 14 cooperates with the cam mechanism 20 to raise the applicator tip 30 from the workpiece 22, and to lower the applicator tip 30 into engagement with the sealant supply 16. After applicator tip 30 has picked up an annular bead of sealant 28, the head reciprocating unit 18 moves the base member 12 back to the first position; the cam mechanism 20 cooperates with the swingable member 14 to lift applicator tip 30 from the sealant supply 16 as applicator tip 30 is moved to the standby position.

Figure 4:
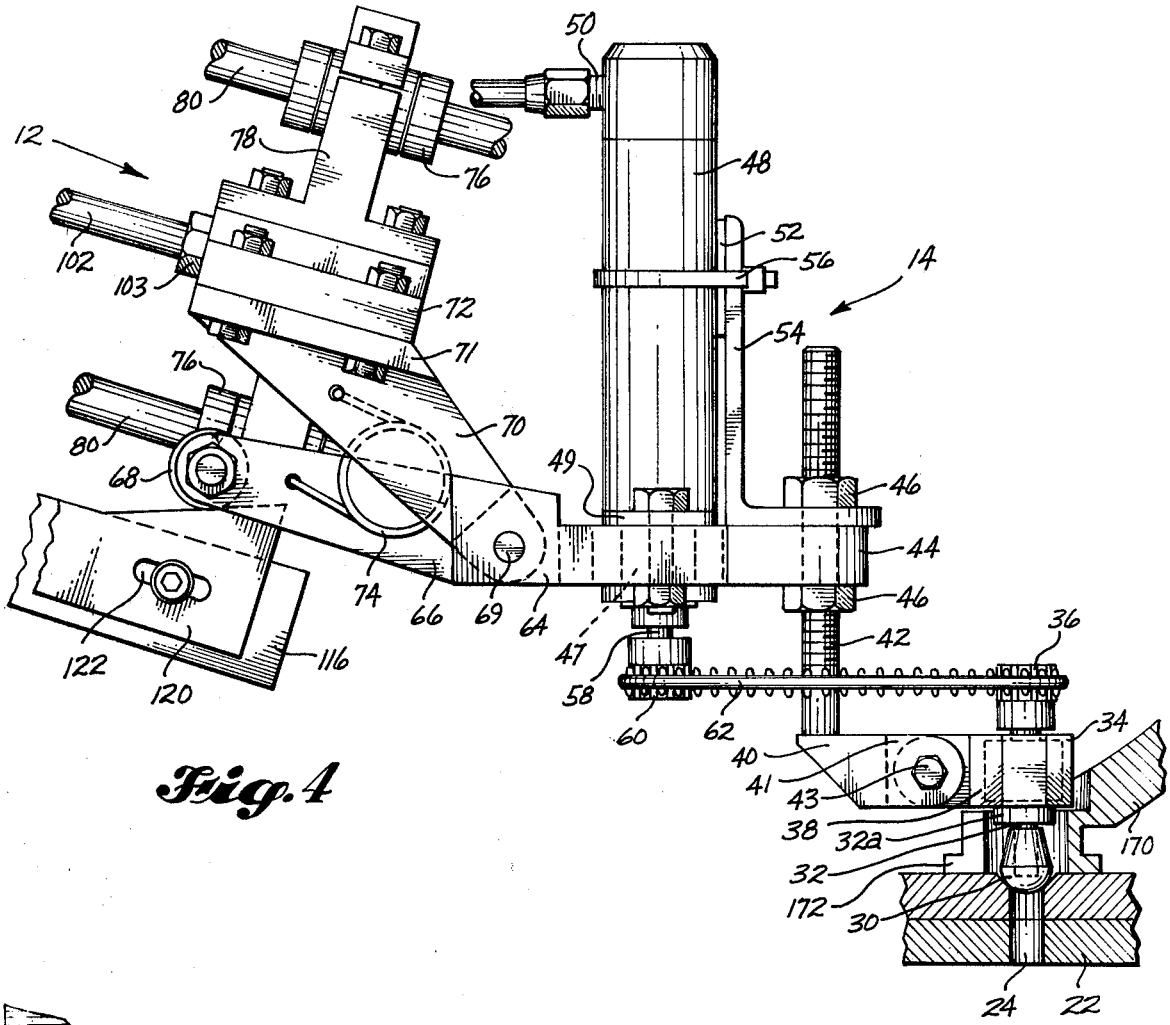
FIG. 4 is an enlarged side elevation view of an applicator head.

Referring to FIG. 4, the swingable member 14 of the applicator head 10 includes a flexible vinyl applicator tip 30, which is snuggly fitted to a downwardly projecting stub shaft 32*a* on a dauber 32. Applicator tip 30 has two differently shaped portions. The upper base portion of the applicator tip 30 fitting snugly onto dauber 32 is frusto-conically shaped. The sides of the upper portion of the dauber diverge downwardly to an integral lower portion. The lower portion of the dauber is convexly contoured and forms the sealant application surface. The preferred shape of the lower portion is generally hemispherical. The applicator tip 30 may also be composed of a resilient material such as a natural or synthetic elastomeric composition. The contoured lower portion of applicator tip 30 adjacent the frusto-conically shaped upper portion is contoured so that it will be slightly distorted when mating with a countersink surface 23 in an aperture 24 in a workpiece 22.

The dauber 32 is rotatably mounted within dauber housing 34. The dauber 32 axially extends through dauber housing 34. A sprocketed pulley 36 is affixed to the end of the dauber 32 opposite applicator tip 30. Plate 38 orthogonally projects from dauber housing 34 and is rotatably mounted on bolt 43 within yoke 41 of the dauber adjusting bracket 40. The axis of bolt 43 is oriented so that the dauber housing can be swung about an axis that is transverse to the dauber 34, and that is preferably horizontal. A screw 42 is integral with and extends upwardly from the upper surface of dauber adjusting bracket 40 at an end opposite to yoke 41. Screw 42 is slidably mounted through dauber support plate 44. Adjusting nuts 46 are tightened on screw 42 above and below the dauber support plate 44, and affix the dauber adjusting bracket 40 in a desired position. Therefore, the applicator tip 30 is adjustable in three dimensions with respect to an aperture 24 in a workpiece 22. The proper slant or pitch of the dauber 32 relative to an aperture 24 in the workpiece 22 may be adjusted by loosening the nut (not shown) on the opposite side of the yoke from the bolt head 43, moving the dauber 32 about the axis of bolt 43 and retightening the nut when the dauber 32 is oriented as desired to plate 38. The proper vertical and lateral position of applicator tip 30 may be adjusted by loosening adjusting nuts 46, rotating the threaded screw 42 with respect to the dauber support plate 44 to the desired orientation, and then retightening adjusting nuts 46.

Air motor 48 is centrally and adjustably bolted to the upper surface of dauber support plate 44. Flanges 49 orthogonally project from the air motor 48 and are parallel with the upper surface of dauber support plate 44. The dauber support plate has slots 47 which permit the air motor to be adjustably positioned thereon in a forward or rearward direction. (For purposes of this specification, rearward is the direction away from a workpiece aperture 24 and forward is the direction toward the workpiece aperture 24.) Air motor 48 extends through an aperature in the dauber support plate 44. A motor shaft 58 axially extends downwardly from air motor 48. A sprocketed pulley 60 is affixed to the end of the axially extending motor shaft 58 and a toothed or cogged belt 62 and engages sprocketed pulleys 60 and 36. Therefore, when air is injected into air motor 48 through air input fitting 50, the motor shaft 58 rotates. Rotation of motor shaft 58 drives belt 62 which in turn causes dauber 32 to rotate at the same speed as motor shaft 58.

To protect the air motor 48 from vibration as it rotates motor shaft 54 at high speeds, air motor 48 is retained to a motor retaining bracket 54. The bottom flange of the L-shaped motor retaining bracket 54 has an opening through which screw 42 extends and adjusting nut 46 affixes the position of bracket 54 on dauber support plate 44. A vibration absorbing spacer 52 is inserted between air motor 48 and the upwardly extending flange of motor retaining bracket 54. A U-shaped fastener 56 surrounds the air motor 48, spacer 52, and the upwardly extending flange of the motor retaining bracket 54 and firmly holds air motor 48 against the vibration absorbing spacer 52.

A yoke 64 extends rearwardly from dauber support plate 44. One flange of yoke 64 constitutes cam follower arm 66 and projects rearwardly a greater distance than the other flange of yoke 64. A cylindrical cam follower roller 68 is rotatively mounted at the end of cam follower arm 66 opposite to dauber support plate 44 for rotation about a generally horizontal axis oriented generally orthogonally to the rotational axis of the swingable member 14 (explained below).

Swingable member 14 of applicator head 10 is hinged on a pin 69 at yoke 64 for rotational movement on the base member at one end of hinge bracket arm 70. Therefore, the pin 69 at yoke 64 becomes the fulcrum for swingable member 14 to swing about an axis that is preferably horizontal and oriented transversely to the longitudinal axis of the guide rods 80. The cam follower arm 66 and the dauber support plate 44 extend from the fulcrum in opposite directions. One end of a torsion wire spring 74 is affixed to hinge bracket arm 70 and the other end of spring 74 is attached to cam follower arm 66 adjacent cam follower roller 68. Thus, the cam follower roller 68 is biased away from guide reference plate 72 and toward cam mechanism 20 (described below). A flange 71 is integral with and projects outwardly at right angles from the upper surface of hinge bracket arm 70 at the end opposite to yoke 64, and is bolted to reference guide plate 72. Therefore, hinge bracket arm 70 extends downwardly and forwardly from guide reference plate 72. Sleeves 76 have a longitudinal axis parallel with the flat upper surface of reference guide plate 72, and are affixed to reference guide plate 72 by sleeve gripping elements 78. The sleeve gripping elements 78 are bolted to reference guide plate 72 and surround sleeves 76, holding the sleeves 76 rigidly in place.

Figures 2, 3, 5:
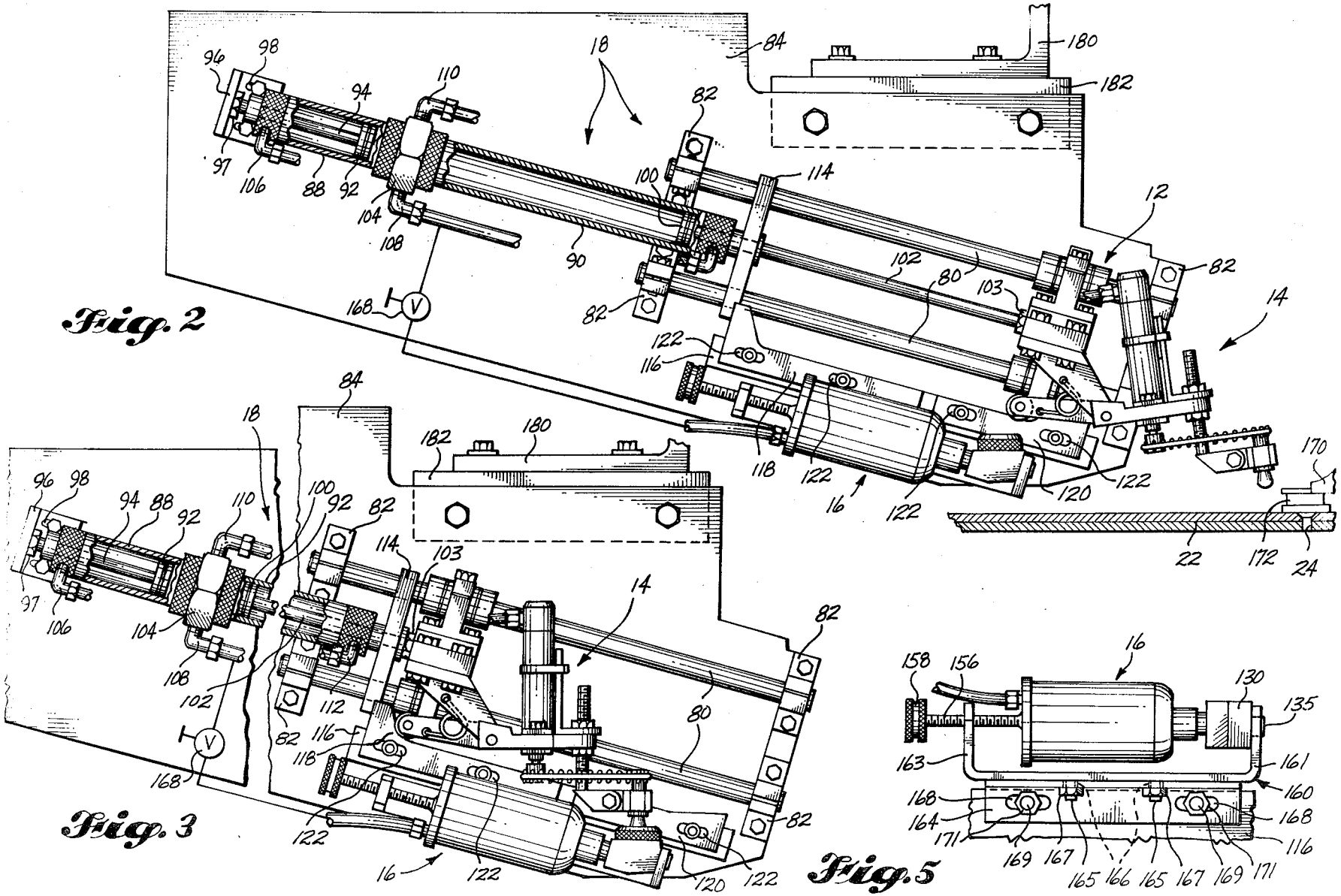
FIG. 2 is a side elevation view of a sealant applicator in a standby position.
FIG. 3 is a side elevation view of a sealant applicator in contact with a sealant supply permeable member number.
FIG. 5 is a bottom view of the sealant supply adjustably positioned on the cam spacer.

Referring to FIGS. 1 through 3, the base member 12 of applicator head 10 is reciprocated in a straight line at an acute angle upwardly and rearwardly relative to the upper surface of the workpiece 22 by head reciprocating unit 18. The direction of reciprocation is established by two parallel guide rods 80. Sleeves 76 of base member 12 surround and slide on the guide rods 80. Sleeves 76 have bushings mounted internally, and the guide rods 80 have a smooth surface, so that the movement of the sleeves 76 on guide rods 80 is substantially friction free. Guide rods 80 are held firmly in place by guide gripping brackets 82. Guide rod gripping brackets 82 grip opposite ends of the guide rods 80, and are bolted to the frame 84.

The sliding movement of base member 12 on guide rods 80 is motivated by a three-position air cylinder 86. The three-position air cylinder used in the illustrative embodiment of this invention is made by Bimba Corporation and is obtainable from Canal Industrial Supply, 1516 N.W. 51st, Seattle, Washington. The three-position air cylinder consists of a large air cylinder 90 (five inch stroke), a small air cylinder 88 (two inch stroke) and spacer housing 104. The large air cylinder 90 is positioned forward of the small air cylinder 88, and the two air cylinders are separated by spacer housing 104. A piston 92 is mounted for sliding movement within the small air cylinder 88. Piston rod 94 is centrally affixed and orthogonally projects from the rearward surface of piston 92, and axially projects rearwardly from the small air cylinder 88. The end of piston rod 94 opposite piston 92 is threadably attached to nut 97, which is affixed to a cylinder anchor flange 96 projecting outwardly from frame 84. Cylinder anchor flange 96 is a right angle flange and has slots 98 on the flange adjacent to and parallel with the frame 84. Therefore, the position of cylinder anchor flange 96 and the three-position air cylinder 86 may be adjusted in a direction parallel with the longitudinal axis of guide rods 80. Piston 100 is slidably mounted within large air cylinder 90. Piston rod 102 orthogonally projects from the forward surface of piston 100 and axially projects forwardly from the large air cylinder 90. The end piston rod 102 opposite piston 100 is threadably attached to nut 103, which is affixed to the rearward surface of reference guide plate 72. Three-position air cylinder 86 is provided with four air fittings to allow air to be injected into and exhausted from small air cylinder 88 and large air cylinder 90 forward and rearward of pistons 92 and 100. Air fitting 106 is located on the rearward end of the small air cylinder 88. Air fitting 108 is located on spacer housing 104 and allows air to be injected into and exhausted from the small air cylinder 88 forward of piston 92. Air fitting 110 is also located on spacer housing 104, and allows air to be injected into and exhausted from large air cylinder 90 rearward of piston 100. Air fitting 112 is located on the forward end of large air cylinder 90.

An air cylinder support 114 is threadably attached to the forward end of large air cylinder 90 forward of air fitting 112. Air cylinder support 114 extends in a perpendicular direction from the longitudinal axis of three-position air cylinder 86, and is mounted for sliding movement on guide rods 80. Air cylinder support 114 insures that the movement of the three-position air cylinder 86 and its component parts is parallel to the longitudinal axis of guide rods 80.

As indicated above, the head reciprocating unit 18 moves base member 12 of applicator head 10 in a straight line to and from three predetermined positions. Starting from the first position, piston 100 is in its forwardmost position within large air cylinder 90, and piston 92 is in its forwardmost position within small air cylinder 88. (See FIG. 2.) To move base member 12 to its second position, wherein applicator tip 30 engages the aperture 24 in a workpiece 22, air is injected into air fitting 108 forward of piston 92, and air is exhausted from air fitting 106 rearward of piston 92 within the small air cylinder 88. Because piston rod 94 is rigidly affixed to the cylinder anchor flange 96, the remaining components of three-position air cylinder 86 are moved forwardly relative to piston 92. Air cylinder support 114 and sleeves 76 of the base member slide on guide rods 80, and therefore the base member is moved forwardly by the amount of relative travel between the piston 92 and the small cylinder 88. (See FIG. 1.) Base member 12 is held in the second position for a predetermined period of time, and then moved to a third position, wherein applicator tip 30 engages the sealant supply 16. First, air is injected into air fitting 106 rearward of the piston 92 and exhausted from air fitting 108 forward of piston 94, and the remaining components of three-position air cylinder 86 move rearwardly relative to piston 92. As soon as the rearward movement of the remaining components of three-position air cylinder 86 relative to piston 92 is completed, air is injected into air fitting 112 forward of piston 100 and exhausted from air fitting 110, rearward of piston 100. Piston rod 102 retracts into the large air cylinder 90, and base member 12 rides on the guide rods in a straight line to the third position. (See FIG. 3.) After a predetermined period of time, base member 12 is then moved back to the first position. Air is injected into air fitting 110 rearward of piston 100 and exhausted from air fitting 112 forward of piston 100. Piston 100 is moved to its forwardmost position within the large air cylinder 90, and piston rod 102 is therefore moved to its fully extended position and pushes base member 12 to the first position ready for application of sealant to a countersink bore.

When base member 12 is moved between the three designated positions, the cam mechanism 20 operates with cam follower 68 of swingable member 14 to allow applicator tip 30 to be lowered to and raised from the aperture 24 in a workpiece 22 and the sealant supply 16, respectively. Referring to FIG. 3, cam spacer plate 116 is attached to frame 84 below guide rods 80. Cam spacer plate 116 has a rectangular longitudinal cross section, and its upper and lower surfaces are parallel with the longitudinal axis of guide rods 80. Two cams, a sealant engagement cam 118 and an aperture engagement cam 120, are adjustably bolted to the side of cam spacer plate 116 opposite frame 84. Cams 118 and 120 have slots 122 which permit the cams 118 and 120 to be independently adjusted in a direction that is parallel with the longitudinal axis of guide rods 80. Cam follower 68 rides on either sealant engagement 118 or aperture engagement cam 120 when base member 12 is moved to and from the three previously described positions.

The aperture engagement cam 120 is positioned forward of the sealant engagement cam 118. Opposite sides of the rearward section of aperture engagement cam 120 and the forward portion of sealant engagement cam 118 are partially cut away so that the aperture engagement cam 120 and sealant engagement cam 118 will intermesh at their respective cutaway portions and present a continuous upper cam surface. From the rearward end of aperture engagement cam 120, approximately three quarters of the upper cam surface is parallel with the longitudinal axis of guide rods 80. The forward portion of aperture engagement cam 120 angles forwardly and upwardly at approximately a 23° angle from the section of the cam 120 that is parallel with the longitudinal axis of guide rods 80. From the forward end of the sealant engagement cam 118, approximately three quarters of the upper camming surface is parallel with the longitudinal axis of guide rods 80 and planar with the corresponding parallel portion of aperture engagement cam 120. The rearward portion of sealant engagement cam 118 slopes upwardly and rearwardly at approximately a 60° angle from the camming surface that is parallel with guide rods 80. The intersection of the angled portions with the planar portion of the cam surfaces of sealant engagement cam 118 and aperture engagement cam 120 are contoured to allow a smooth transition between the camming surfaces.

Figures 6, 7, 8, 9, 10, 11:
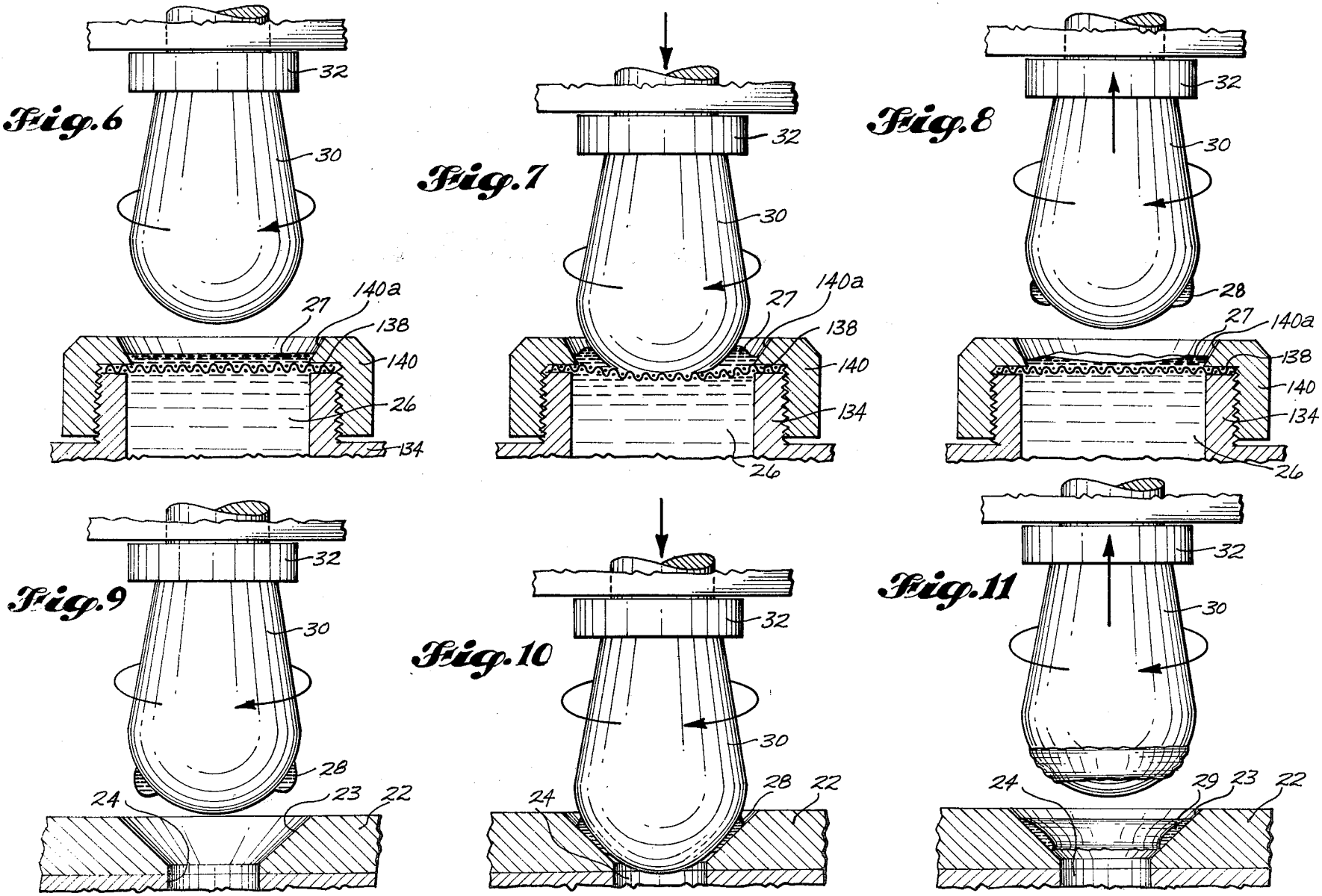
FIG. 6 is an enlarged schematic representation of a side elevation view of the applicator tip positioned above the screens of the sealant supply.
FIG. 7 is an enlarged schematic representation of a side elevation view of the applicator tip shown in engagement with the screen of the sealant supply.
FIG. 8 is an enlarged schematic representation of a side elevation view of the applicator tip lifted from the screens of the sealant supply.
FIG. 9 is an enlarged schematic representation of a side elevation view of the applicator tip positioned above a countersink surface of a workpiece aperture.
FIG. 10 is an enlarged schematic representation of a side elevation view of the applicator tip engaging the countersink surface of a workpiece aperture.
FIG. 11 is an enlarged schematic representation of a side elevation view of the applicator tip lifted from the countersink surface of a workpiece aperture.

When base member 12 is in the first position, the cam follower 68 of swingable member 14 is contacting the upper cam surface of aperture engagement cam 120 adjacent the upwardly and forwardly inclined portion of the cam. (See FIG. 2.) When base member 12 is moved to the second position, cam follower 68 moves up the inclined portion of aperture engagement cam 120. The swingable member 14 rotates about its fulcrum and applicator tip 30 is gradually lowered so that it engages the countersink 23 of the workpiece aperture 24 when base member 12 reaches its second position. (See FIG. 1.) When base member 12 is moved from the second position to the third position, cam follower 68 moves down the incline on the aperture engagement cam 120 under the biasing force of torsion spring 74. The swingable member 14 rotates about its fulcrum and raises the applicator tip 30 from the countersink 23 in the workpiece aperture 24. Applicator tip 30 remains in the raised position as cam follower 68 rolls on the planar portions of aperture engagement cam 120 and sealant engagement cam 118. When applicator tip 30 is adjacent to the reservoir 130 of the sealant supply 16, cam follower 68 moves up the rearwardly and upwardly sloped portion of sealant engagement cam 118 as the base member 12 moves to its third position. Swingable member 14 is rotated about its fulcrum and applicator tip 30 is gradually lowered so that the tip 30 engages the screen 138 of reservoir 130 when base member 12 reaches its third position. (See FIGS. 3 and 7.) When base member 12 is moved back to the first position, cam follower 68 moves down the inclined portion of sealant engagement cam 118. The swingable member 14 rotates about its fulcrum and applicator tip 30 is lifted from reservoir 130 of the sealant supply 16. The applicator tip 30 remains in the raised position as cam follower 68 rolls on the planar portion of sealant engagement cam 118 and aperture engagement cam 120 when the base member is moved to the first position in readiness to apply sealant to a countersink bore.

Referring to FIG. 5, the sealant supply 16 is affixed within a C-shaped retaining bracket 160. The longitudinal portion of retaining bracket 160 is oriented in a direction generally parallel with the longitudial axis of guide rods 80. A forward flange 161 projects outwardly away from frame 84 at the forward end of the retaining bracket 160 and has a rectangular slot to engage a forwardly projecting rectangular key 135 from reservoir 130 of sealant supply 16 (as described below). A rearward flange 163 projects outwardly away from frame 84 at the rearward end of retaining bracket 160 and has a threaded aperture to engage screw 156 of the sealant supply 16 (as described below).

A right angle flange 164 is adjustably attached to retaining bracket 160. Threaded pins 165 are welded to and orthogonally project from the longitudinal portion of retaining bracket 160 adjacent the frame. The threaded pins 165 extend through slots 166 in the section of right angle flange 164 making contact with the retaining bracket 160 and nuts 167 are tightened on pins 165 to affix the position of the retaining bracket 160 relative to right angle flange 164. The slots 166 are oriented in a direction transverse to the longitudinal axis of the guide rods 80 which allows adjustment of the retaining bracket in that direction. Additionally, slots 166 have a width greater than the pin's 165 diameter which permits slight angular adjustment of the retaining bracket in the pitch or slant direction relative to the longitudinal axis of the guide rods 80. The second flange of right angle flange 164 projects orthogonally from retainer bracket 160 and is parallel with and above pins 165. The second flange has slots 168 which allow the retaining bracket 160, and therefore the entire sealant supply 16, to be adjusted in a direction that is parallel with the longitudinal axis of guide rods 80. Downwardly projecting bolts 169 from cam spacer plate 116 extend through the slots 168 in the flange and nuts 171 are tightened on the downwardly projecting bolts to adjustably locate retaining bracket 160 in a fixed position.

Figure 5A:
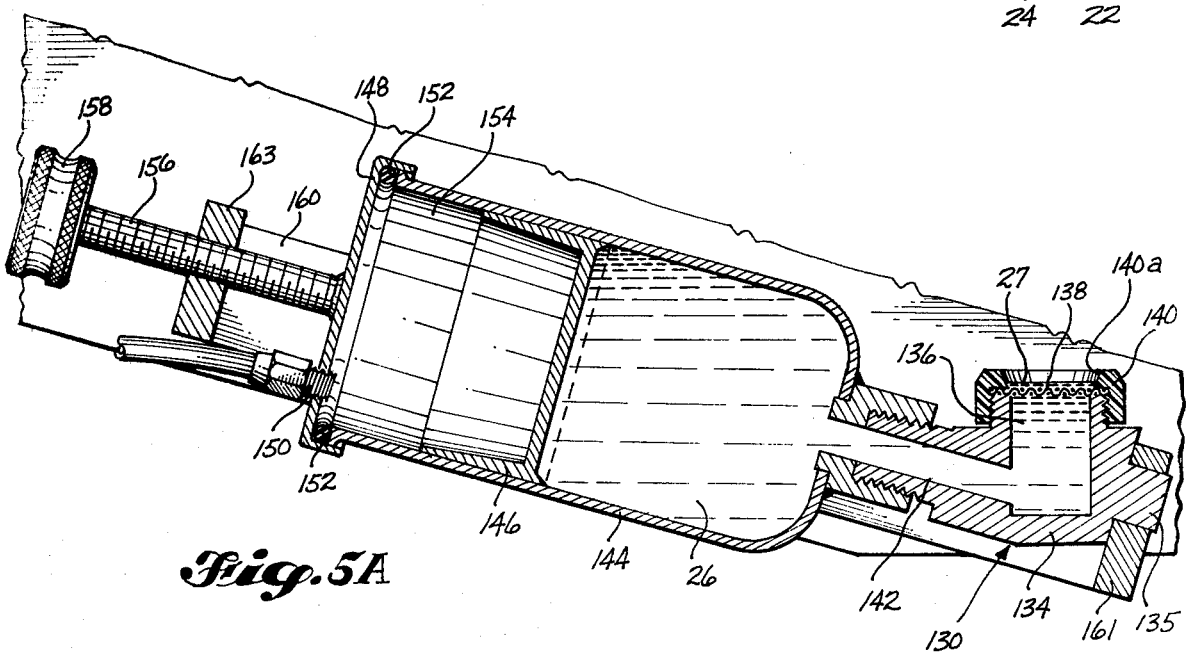
FIG. 5*a* is a longitudinal sectional view of the sealant supply.

Referring now to FIG. 5*a*, reservoir 130 of sealant supply 16 has a housing 134, and receiving (142) and storage (132) chambers located therein. The housing 134 has circular opening 136 in its upper surface. The upper surface of housing 134 is parallel to the upper surface of the workpiece. Two circular-shaped nylon screens 138 have a diameter larger than the opening 136 in the upper surface of housing 134, and are retained over the opening 136 by a circular rimmed reservoir cap 140. Reservoir cap 140, having a central opening 140*a*, threadably engages a cylindrical extension of the reservoir housing 134, and is tightened down so that an internal annular shoulder surrounding the opening 140*a* of reservoir cap 140 holds screens 138 in place about the screen's circumference. The rim of reservoir cap 140 acts as a retaining wall for the sealant 27 deposited above screens 138. A rectangular key 135 projects orthogonally from the forward surface of reservoir housing 134 and slides into a rectangular slot of slightly larger cross-sectional dimensions in the forward flange 161 of retaining bracket 160. A cylindrical receiving chamber 142 radially extends rearwardly from the bottom of vertical storage chamber 132 at an angle parallel with the longitudinal axis of guide rods 80. The housing 134 adjacent the receiving chamber 142 is threadably attached to a standard sealant container cartridge 144. Sealant container cartridge 144 is marketed by Semco a division of Products Research and Chemical Corp., 5454 San Fernando Rd., Glendale, CA. A free floating piston 146 is slidably mounted within sealant container cartridge 144 above the sealant 26. A cartridge cap 148 covers the end of sealant container cartridge 144 opposite reservoir 130 and is fitted with an air input fitting 150, and a gasket 152. The gasket 152 contacts the end of sealant container cartridge 144 to create a sealed variable volume chamber 154 therein above free floating piston 146. Screw 156 is centrally welded to and projects orthogonally from cartridge cap 148 and threadably engages the rearward outwardly projecting flange 163 of the C-shaped retaining bracket 160. Knob 158 is welded to screw 156. By turning knob 158 in one direction, cartridge cap 148 is tightened down on sealant container cartridge 144; the key 135 on reservoir housing 134 slides into the slot in the forward flange 161 of retaining bracket 160; so that the forward surface of reservoir housing 134 abuts the rearward surface of forward flange 161, and the sealant supply 16 is fixed in a rigid position. By turning knob 158 in the other direction, cartridge cap 148 is loosened from sealant container cartridge 144; and the sealant container cartridge 144 and reservoir 130 may be removed from retainer bracket 160.

When applicator tip 30 is initially lifted from the countersink surface of a workpiece aperture and started moving toward the retracted or third position, air exhausted from air fitting 108 on the three-position cylinder is sent to a needle valve 168. (See FIGS. 1 through 3.) A portion of this exhaust air is injected into the variable volume chamber 154 through air fitting 150. The exhaust air acts on free floating piston 146 which in turn impinges upon the sealant 26 within sealant container cartridge 144, forcing sealant through the screens 138. Since air is injected into the chamber 54 at predetermined intervals corresponding to actuation of the three-position cylinder, a predetermined amount of sealant 27 is therefore passed through and deposited above the permeable screens 138 within the reservoir cap 140 to maintain a given level of sealant above the screens after each application cycle. Needle valve 168 may be adjusted to inject more or less air into the variable volume chamber 154 of sealant container cartridge 144, if a different level of sealant 27 above screens 138 is required.

The illustrative embodiment of this invention may be suspended from a support structure, for example, from an automatic riveting machine. A frame supporting flange 182 is bolted to the upper portion of frame 84. Hanger bracket 180 is adjustably affixed to the frame supporting flange 182, and is bolted to a support structure.

Referring now to FIGS. 6 through 11, the constantly rotating applicator tip 30 is shown picking up an annular bead of sealant 28 from the screens 138 within reservoir 130, and depositing the annular bead of sealant 28 on a countersink surface 23 of a workpiece bore 24. As the rotating applicator tip 30 approaches screens 138, a predetermined amount of sealant 27 has been provided above the screens 138. See FIG. 6. When the hemispherical portion of vinyl applicator tip 30 presses down on screens 138, the screens 138 are deformed slightly downwardly at the point of contact, and the bottom section of the flexible applicator tip 30 is flattened slightly to conform with the shape of screens 138. The bottom section of applicator tip 30 that contacts screens 138 either pushes sealant 27 back through the screens 138 or pushes sealant 27 off to the sides of applicator tip 30 adjacent the bottom section actually contacting the screens 138. See FIG. 7. Sealant 27 attaches to the hemispherically shaped portion of applicator tip 30 adjacent the bottom section of the applicator tip 30 contacting the screens 138. Sealant 27 does not attach to the bottom section of the rotating applicator tip 30 contacting screens 138, because the screens 138 shear off sealant 27 from that particular section of applicator tip 30. As the rotating applicator tip 30 is lifted from screens 138, the sealant 28 attached to applicator tip 30 adjacent the bottom section of the applicator tip 30 is sheared from the sealant 27 remaining above the screens 138 adjacent the rim of reservoir cap 140. As a result, an annular bead of sealant 28 is formed on the hemispherically shaped portion of applicator tip 30. See FIG. 8. The annular bead of sealant 28 on applicator tip 30 is then placed on the countersink surfaces 23 of a workpiece aperture and is flattened out as the applicator tip 30 is pressed down and mates with countersink surface 23. See FIGS. 9 and 10. As the applicator tip mates with the countersink surface, a portion of the sealant on the rotating applicator tip 30 is attached to the countersink surface. As applicator tip 30 is lifted from the countersink surface 23 of the workpiece aperture 24, sealant 29 on the countersink surface is sheared from the sealant 28 remaining on the applicator tip 30. A band of sealant remains on applicator tip 30, and a band of sealant 29 is evenly distributed on the countersink surface 23 of the workpiece aperture 24. See FIG. 11.

The applicator is designed for use with an automatic riveting machine a having a drill, a riveter and a work support device such as a pressure foot 172 with a pressure foot bushing 170. Such an automatic riveting machine is the Drivematic, G39A and G400 models, manufactured by General Electro-Mechanical Corp., 785 Hertel Ave., Buffalo, N.Y. The applicator is installed on the automatic riveting machine by first positioning the applicator to allow unobstructed movement of the applicator head 10 from the third position, shown by FIG. 3, to the second position, shown by FIG. 1. Hanger bracket 180 is then affixed to the automatic riveting machine. With the head in the second position, the dauber 32 (without the applicator tip 30) is approximately aligned with the centerline of the workpiece aperture 24, and the frame supporting flange 182 is bolted to the hanger bracket 100. The dauber 32 is then precisely aligned relative to the centerline of the workpiece bore 24 within the pressure foot bushing 170 by three-dimensionally adjusting the dauber 32 on the dauber support plate 44. Next, the applicator tip 30 is fitted to the dauber 32 and the applicator tip 30 is moved to its supply position. The sealant supply retaining bracket 160 is adjusted relative to cam spacer plate 116 so that the applicator tip 30 contacts the screens 138 with the correct amount of pressure to position the annular bead of sealant 28 on the applicator tip 30. The retainer bracket 160 is then bolted to the cam spacer plate 116. Cams 118 and 120 may be adjusted relative to cam spacer plate 116 and the three-position air cylinder 86 may be adjusted relative to frame 84 to assist in aligning the applicator tip 30 with respect to the centerline of the workpiece aperture 24, and with the screens 138 of the sealant supply 16.

The complete sealant cycle will now be described when used with the "Drivematic G400" automatic riveting machine. Starting with the standby position, shown by FIG. 2, the applicator tip 30 is positioned adjacent to the pressure foot bushing 170, nd is constantly rotating at approximately 2,500 rpm or about 4 revolutions per 0.1 second. After the bore 24 is drilled and countersunk, a signal from the riveting machine starts the applicator cycle. The signal starts a first timer, energizes a first solenoid controlled pneumatic valve and air is appropriately injected into and exhausted from a portion of the three-position air cylinder 86. The applicator tip 30 is moved to and held in its workpiece engagement position, as previously described. The first timer allows the applicator tip 30 to be held in contact with the countersink surface 23 of the workpiece bore 24 for approximately 0.1 second. During this time the applicator tip 30, by rotating at about 2,500 rpm, evenly distributes an annular band of sealant 29 on the countersink surface 23. When the first timer runs down, a second timer is activated, a second solenoid controlled pneumatic valve is also activated and air is appropriately injected into and exhausted from the three-position air cylinder 86. The applicator tip 30 is moved to and held in its supply position, as previously described. See FIG. 3. The second timer allows the applicator tip 30 to be held in the supply position for a sufficient time period, e.g. 0.5 second, so that an annular bead of sealant is formed on the applicator tip 30 adjacent to the portion of the tip 30 contacting the screens 138. At the completion of the supply cycle, the second solenoid valve is de-energized, air is appropriately injected into and exhausted from the three-posiiton air cylinder 86, and the applicator tip 30 returns to the standby position, as previously described. The applicator tip 30 remains in the standby position until a signal from the riveter activates the next cycle.

While the preferred embodiment has been illustrated and described, it will be appreciated by those skilled in the art and others that various changes can be made without departing from the spirit and scope of the invention. For example, the shape of the applicator tip can be modified so that the applicator is adaptable to providing sealant for a considerable range of countersink angles, (even a straight bore) and a broad range of aperture sizes. The sealant supply may be modified to be reciprocably moved to contact the applicator tip in the standby position. Different apparatus may be used to adjustably position the dauber to allow fine adjustments for alignment of the applicator tip with respect to a centerline of a workpiece bore. The apparatus for reciprocating the applicator head may be varied without departing from the scope of this invention. Additionally, the cam mechanism and cam follower may be modified. Moreover, the sealant supply may be modified to provide a different shearing surface. It will be recognized that the combination of the flexible applicator tip and the sealant supply with a permeable shearing member of this invention yield a combination of related advantages which are unique to this art. It is therefore intended that the protection granted by Letters Patent hereon be limited only by the definition contained in the appended claims and equivalents thereof.

The embodiments of the invention in which an exclusive property or privilege is claimed are defined as follows:

1. An applicator for applying an annular bead of sealant to a wall of an aperture in a workpiece comprising:

an applicator head having a dauber rotatively mounted thereon, said dauber having an end and a flexible, convexly contoured applicator tip affixed to said end, means associated with said applicator head for rotating said dauber, a sealant supply including a reservoir and supply means for supplying said reservoir with sealant, said reservoir having an opening and a sealant-permeable member operably associated with said opening, said permeable member having a shearing surface communicating with the exterior of said reservoir, said supply means for supplying sealant to said reservoir to feed sealant through said permeable member to provide a predetermined amount of sealant evenly over said shearing surface, means associated with said applicator head for moving said applicator tip between a first position wherein said applicator tip contacts said shearing surface to receive an annular bead of sealant thereon and a workpiece engagement position wherein said applicator tip engages the aperture wall in said workpiece to apply an annular bead of sealant to said aperture wall.

2. The applicator of claim 1 wherein said applicator tip has upper and lower portions, said upper portion being snuggly fitted to said dauber, and said lower portion being hemispherically shaped.

3. The applicator of claim 2 wherein said means for moving said applicator tip further moves said applicator tip to a standby position located between said supply and said workpiece engagement positions, said applicator tip in said standby position being located adjacent said workpiece aperture in readiness for movement to said workpiece engagement position.

4. The applicator of claim 3 wherein said applicator head includes a base member and a swingable member mounted for rotation about an axis on said base member, said dauber being rotatively mounted on said swingable member, and wherein said means for moving said applicator tip comprises:

reciprocating means associated with said base member for moving said base member in a straight line between first, second and third positions, and cam means for rotating said swingable member about said axis in reaction to movement of said base member between said first, second and third positions, said axis being transverse to said straight line path of travel of said base member, said cam means rotating said swingable member to a location wherein said applicator tip is remote from said supply position and said workpiece engagement position when said base member moves to said first position, said cam means rotating said swingable member so as to position said applicator tip in said workpiece engagement position when said base member moves to said second position, said cam means rotating said swingable member so as to position said applicator tip in said supply position when said base member moves to said third position.

5. The applicator of claim 4 wherein said swingable member also includes a dauber support plate, a dauber housing, and means for adjustably mounting said dauber housing on said dauber support plate for three-dimensional adjustment relative to said dauber support plate.

6. The applicator of claim 5 wherein said reciprocating means includes a three-position pneumatic cylinder operably connected to said base member for selectively driving said base member between said first, second and third positions, and guide means associated with said base member for maintaining the path of travel of said base member in said straight line.

7. The applicator of claim 6 wherein said permeable member is a screen.

8. The applicator of claim 7 wherein said screen is composed of nylon.

9. The applicator of claim 8 wherein said supply means for supplying said reservoir with sealant includes a sealant container having fluid communication with said reservoir, piston means slidably mounted within said sealant container for contacting sealant within said sealant container, and pneumatic means communicating with said three-position pneumatic cylinder for intermittently applying a predetermined force on said piston means.

10. The applicator of claim 9 wherein said sealant container and said reservoir are adjustably mounted below said cam means, said sealant container and said reservoir being adjustable in a direction parallel with and transverse to the straight line path of travel of said base member.

11. The applicator of claim 10 wherein said cam member is adjustable in a direction parallel with the straight line path of travel of said base member.

12. The applicator of claim 11 wherein said cam means comprises:

means defining a cam surface mounted beneath said guide means, said cam surface having a forward, rearward and middle section relative to said workpiece aperture, said middle section of said cam member being parallel with the straight line path of travel of said base member, said rearward section being sloped in a rearward and upward direction from said middle section, and said forward section being sloped in a forward and upward direction from said middle section, cam following means associated with said swingable member so as to make contact with and be adjustably positioned by said cam surface, and biasing means associated with said base member and said swingable member for urging said cam following means onto said cam surface.

13. An applicator tip for picking up an annular bead of sealant from a supply source comprising:

an applicator head having a dauber rotatably mounted thereon, said dauber having an end and an applicator tip affixed to said end, means associated with said applicator head for rotating said dauber, an open reservoir and supply means for supplying said reservoir with sealant, said reservoir having a deformable sealant-permeable member operably associated with said opening, said permeable member having a shearing surface communicating with the exterior of said reservoir, said reservoir and said supply means cooperating to cause a predetermined amount of sealant to permeate said sealant-permeable member, and means associated with said applicator head for moving said applicator tip between a position remote from said shearing surface and a position wherein at least a portion of said applicator tip is in contact with said shearing surface when said dauber is being rotated.

14. An applicator for picking up an annular bead of sealant from a supply source comprising:

an applicator head having a dauber rotatably mounted thereon, said dauber having an end and a convexly countoured applicator tip affixed to said end, means associated with said applicator head for rotating said dauber, an open reservoir and supply means for supplying said reservoir with sealant, said reservoir having a sealant-permeable member operably associated with said opening, said permeable member having a shearing surface communicating with the exterior of said reservoir, said reservoir and said supply means cooperating to cause a predetermined amount of sealant to permeate said sealant permeable member, and means associated with said applicator head for removing said applicator tip between a position remote from said shearing surface and a position wherein at least a portion of said applicator tip is in contact with said shearing surface when said dauber is being rotated.

15. An applicator for picking up an annular bead of sealant from a supply source comprising:

an applicator head having a dauber rotatably mounted thereon, said dauber having an end and a deformable applicator tip affixed to said end, means associated with said applicator head for rotating said dauber, an open reservoir and supply means for supplying said reservoir with sealant, said reservoir having a sealant-permeable member operably associated with said opening, said permeable member having a shearing surface communicating with the exterior of said reservoir, said reservoir and said supply means cooperating to cause a predetermined amount of sealant to permeate said sealant permeable-member, and means associated with said applicator head for moving said applicator tip between a position remote from said shearing surface and a position wherein at least a portion of said applicator tip is in contact with said shearing surface when said dauber is being rotated.

* * * * *

UNITED STATES PATENT AND TRADEMARK OFFICE

CERTIFICATE OF CORRECTION

PATENT NO. : 4,135,476

DATED : January 23, 1979

INVENTOR(S) : Josiah Thomas Duryea

It is certified that error appears in the above-identified patent and that said Letters Patent are hereby corrected as shown below:

Column 5, line 47: "snuggly" is changed to --snugly--.

Column 6, line 34: "aperature" is changed to --aperture--.

Column 13, line 11: "nd" is changed to --and--.

Column 14, line 27: "first" is changed to --supply--.

line 36: "snuggly" is changed to --snugly--.

Column 15, line 35: "member" is changed to --means--.

line 55: delete "tip"

Column 16, line 20: "countoured" is changed to --contoured--.

line 31: "sealant permeable" is changed to --sealant-permeable-- lines 33-34: "removing" is changed to --moving--.

line 53: "sealant permeable" is changed to --sealant-permeable--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*